US005688544A

United States Patent [19]

Bolton et al.

[11] Patent Number: 5,688,544

[45] Date of Patent: Nov. 18, 1997

[54] EASY OPENING VENTABLE CLOSURE FOR SEALED PARTICULATE PRODUCT PACKAGE

[75] Inventors: Stewart L. Bolton, Springfield, N.J.; Michael E. Delonis, New York, N.Y.

[73] Assignee: Kraft Foods, Inc., Northfield, Ill.

[21] Appl. No.: 424,680

[22] Filed: Apr. 18, 1995

[51] Int. Cl.[6] ..... B65D 41/32

[52] U.S. Cl. ..... 426/118; 426/123; 426/131; 156/69; 215/232; 215/310; 220/203.16; 220/231; 220/256; 220/270; 220/359; 220/360; 220/361

[58] Field of Search ..... 426/118, 123, 426/125, 131; 220/231, 257, 256, 260, 270, 271, 360, 361, 366.1, 373, 359, 367.1, 369, 254, 712, 714, 715, 203.11, 203.16; 156/69; 215/232, 307, 310

[56] References Cited

U.S. PATENT DOCUMENTS

| | | | |
|---|---|---|---|
| 3,197,059 | 7/1965 | Anderson | 220/203.16 X |
| 3,273,745 | 9/1966 | Stec | 220/231 |
| 3,281,024 | 10/1966 | Henchert et al. | 220/260 X |
| 3,292,828 | 12/1966 | Stuart | 220/260 X |
| 3,302,818 | 2/1967 | Balocca et al. | 220/231 |
| 3,307,737 | 3/1967 | Harvey et al. | 220/231 X |
| 3,312,368 | 4/1967 | Reynolds et al. | 220/231 X |
| 3,401,820 | 9/1968 | Taylor | 220/54 |
| 3,416,699 | 12/1968 | Bozek | 220/231 |
| 3,434,622 | 3/1969 | Czecledy | 220/231 |
| 3,441,167 | 4/1969 | Balocca | 220/271 |
| 3,485,410 | 12/1969 | Boik | 220/271 |
| 3,593,876 | 7/1971 | Fraze | 220/271 |
| 3,627,168 | 12/1971 | Fraze | 220/271 |
| 3,659,739 | 5/1972 | Luviano et al. | 220/367.1 X |
| 3,720,348 | 3/1973 | Jakobsen | 220/54 |
| 4,029,033 | 6/1977 | Kerwin et al. | 156/69 X |
| 4,098,404 | 7/1978 | Markert | 206/525 |
| 4,135,637 | 1/1979 | Hannula | 220/271 |
| 4,146,149 | 3/1979 | Beveridge | 220/271 |
| 4,163,506 | 8/1979 | Patterson | 220/271 X |
| 4,182,460 | 1/1980 | Holk, Jr. et al. | 220/271 |
| 4,215,791 | 8/1980 | Brochman | 220/271 X |
| 4,378,074 | 3/1983 | Brochman | 220/260 |
| 4,405,056 | 9/1983 | Patterson | 220/271 |
| 4,500,011 | 2/1985 | Brochman | 220/359 |
| 4,572,398 | 2/1986 | Juty | 220/271 |
| 4,928,845 | 5/1990 | Doyle | 220/271 |
| 5,344,662 | 9/1994 | Payne et al. | 426/124 |
| 5,395,005 | 3/1995 | Yoshida | 220/359 |

FOREIGN PATENT DOCUMENTS 1309992 9/1989 Canada .

OTHER PUBLICATIONS

Alusingen Manufacturer's Brochure entitled, "ALUFIX® Laminate Stock for Easy Opening Can Ends", May 1981.

*Primary Examiner*—Milton Cano
*Attorney, Agent, or Firm*—Thomas A. Marcoux; Thomas R. Savoie

[57] ABSTRACT

A container for packaging a particulate product under pressure or vacuum conditions with an easy opening closure structure which allows venting prior to uncovering of the product opening. In one form, an easy peel flexible lid covers a shelf area and a product opening in the top of the can. Peeling back the lid first uncovers the vent opening, permitting the flow of gases but preventing the flow of particulate product, and then uncovers the product opening. Alternatively, the closure structure may be formed by multiple layers of a flexible material, the lower layer of which has the vent opening which is uncovered by peeling back the top layer, after which the product opening is uncovered.

41 Claims, 10 Drawing Sheets

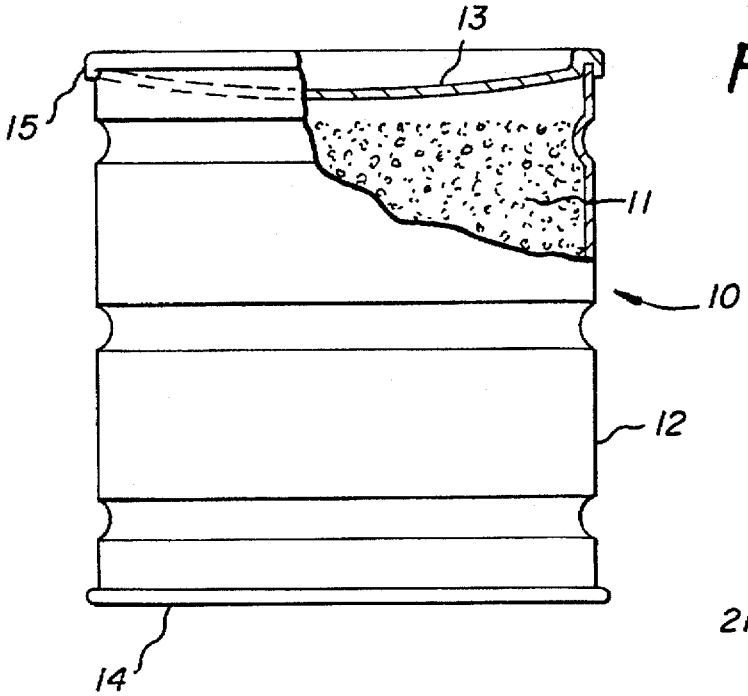
FIG. 1
FIG. 2
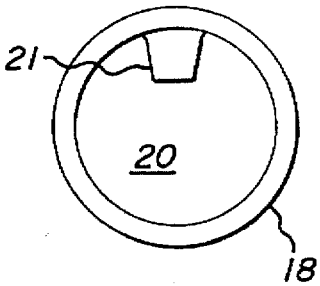
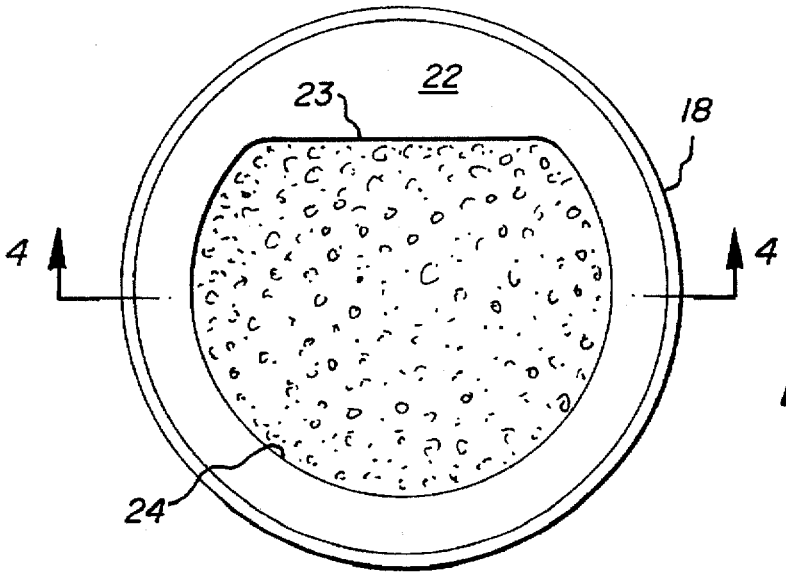
FIG. 3
FIG. 4
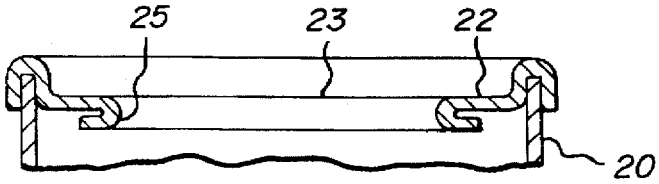

EASY OPENING VENTABLE CLOSURE FOR SEALED PARTICULATE PRODUCT PACKAGE

FIELD OF THE INVENTION

This invention relates to the packaging of a particulate product, and it relates in particular to the packaging of a particulate product packed with a pressure differential between the interior of the package and the surrounding atmosphere.

The invention relates more specifically to an improved easy opening closure structure for a sealed package containing a particulate product such as roast and ground coffee under pressure, which closure structure will allow venting of gases while substantially preventing egress of the particulate product such as the roast and ground coffee, during initial opening of the package.

BACKGROUND OF THE INVENTION

Conventional packaging for roast and ground coffee has involved subjecting the freshly roast and ground coffee product to a degassing process. This process usually involves allowing the roast and ground coffee to set for a predetermined period of time to allow degassing, after which the roast and ground coffee is packaged under vacuum conditions. The goal of this procedure is to reduce to an acceptable minimal level the oxygen content of the gas within the can, and especially in the headspace, since oxygen tends to stale the coffee product.

More recently, it has become known to package the roast and ground coffee product under pressure conditions. In one such process, as described in commonly owned Canadian Patent No. 1,309,992 immediately after the grinding step, the gases in the vicinity of the coffee product are purged using carbon dioxide. This process has the distinct advantage of completing the packaging of the coffee product immediately after the grinding step, thus avoiding the need for additional time to allow the coffee product to set for degassing. The product can then be packaged under atmospheric pressure or under pressure. After the package is sealed, released carbon dioxide will cause an increase in pressure in the package. The finished product will generally have a positive pressure, typically between 5 to 9 psig.

Whether one uses the above described process or any other process for packaging a particulate product such as roast and ground coffee under pressure, certain concerns must be addressed. Upon initial opening of the package, there is a rush of gas from the interior of the package to the exterior thereof, which rush, if unobstructed, would carry the particulate product with it, thereby causing a mess in the vicinity surrounding the newly opened package. However, if one properly controls the opening structure, this rush of gas can become an advantage by allowing a pleasurable burst of coffee aroma, while restraining the particulate product itself.

Roast and ground coffee is now typically packaged in a cylindrical plated steel can having a conventional sealed top closure which is openable by puncturing with a can opener or other tool. Such a closure structure, while commonplace, has the recognized disadvantage that a certain level of difficultly is involved in opening the can.

Further, when dealing with the need to control the flow of gas upon initial venting from a pressurized package, such conventional closure structures have an added disadvantage. In such closure structures, the initial opening is formed by an initial puncture hole of the can opener, opening tool or the like, in which case the size of the opening, the timing of effecting the opening and the gas flow speed are essentially unpredictable, thus allowing no control whatsoever over the size, shape, timing and desired gas flow rate of the critical initial opening of the package and its associated gas burst.

Packages such as cans with vent openings for venting gases have been known for many years, including some for vacuum packed containers, to control the rush of air into the package and some for pressure packed containers, to control the flow of gas out of the package.

Examples of prior patents illustrating venting of gases from pressurized coffee cans, and for controlling the outflow of particulate product include the Taylor U.S. Pat. No. 3,401,820, the Jakobsen U.S. Pat. No. 3,720,348 and the Payne et al U.S. Pat. No. 5,344,662. Taylor describes a vent opening for a tab type can. Jakobsen describes a can for packaging particulate product under either vacuum or pressure and having a special area which is punctured prior to opening of the can to allow venting. Payne discloses a venting mechanism for a pressurized coffee can having a conventional sealed lid openable by a conventional can opener or the like.

Also known are easy opening closure structures comprising a lid in the form of a membrane which is adhered to the end of a can by a sealant which allows the membrane to be easily removed by peeling. One such structure consists of a flexible foil/plastic composite structure which is heat sealed to a flat area on the end of the container. Such structures, which are made by Aluminium-Walzwerke Singen Gmbh, ALUSINGEN-Platz D-7700 Singen/Hohentwiel, Federal Republic of Germany, are described in this company's literature dated Apr. 4, 1987 entitled "ALUFIX®-Laminate Stock for Easy Opening Can Ends". Such laminated membranes may be made of different materials including Surlyn or heat-sealing lacquers used as heat-sealing coatings. Polyamides used as heat-sealing coatings are similarly employable. Such closures have come to be known as Rychiger type closures. Easy opening peelable closures are also described in the Markert U.S. Pat. No. 4,098,404.

Notwithstanding the known technology discussed above, there remains a need for a sealed package containing particulate product under pressure, which package has a closure structure which can be easily opened and which concurrently allows control over the timing, volume and speed of the gas flow out of the package during the initial opening thereof.

SUMMARY OF THE INVENTION

Thus, it is a purpose of the present invention to provide a new and improved package for particulate product such as roast and ground coffee packaged under vacuum or pressurized conditions, but especially pressurized conditions, having a closure structure which is easy opening and which concurrently allows control over the timing and flow rate of gas through the initial opening while concurrently, in the case of a pressurized can, preventing egress of the particulate material out of the can.

This purpose is achieved by providing at the end of the package, such as at the top of a can which has the main product access opening, a first layer which contains the gas vent opening or openings, separate from the product access opening and a second layer, easily removable from the first layer by peeling, which covers the vent opening or openings. Generally, continued movement of the second layer, after venting, will uncover the product access opening.

In one preferred embodiment of the present invention, the first layer is a portion of a conventional sealed can top. Specifically, it is conventional at its periphery wherein it is sealed to the top of the side wall of the container, differing from a conventional top in that it contains a relatively large opening for access to the product, but this opening being sufficiently smaller than the diameter of the can so as to leave a sufficient shelf area for forming the vent opening or openings therein and for sealing the easy peel lid membrane thereto.

In this preferred embodiment, the access opening can take different shapes. A preferred shape would be a partially circular access opening, with a portion of the circle terminating at a straight line across the circle, leaving a leveler edge and a relatively large shelf area on one side for the vent opening or openings and its associated sealant. In other preferred embodiments, the access opening can be a complete circle, either concentric with the outer periphery of the can or offset to one side thereof.

In a preferred form, the vent opening structure would be a slit formed by stamping a bar through the first layer, provided that the first layer is a stiff metal, for example a portion of a conventional sealed can top. A single stamped slit may be adequate or there may be a plurality of them. In other embodiments, the vent opening structure may comprise a plurality of microholes or cut slits large enough to allow egress of gases but small enough to prevent egress of the particulate product.

In other arrangements of this embodiment, the vent opening structure may comprise either a single large opening or a plurality of relatively large openings which, in and of themselves are large enough to permit egress of both gases and particulate product; but in these arrangements, the sealant pattern would be such that at the instant when the pressure seal is broken, the said relatively large opening or openings are still covered by the easy peel lid which is connected to the first layer by a sealant pattern which creates a relatively lengthly gas flow path between the two layers, which path can be traversed by the gases, but not by the particulate product.

In other preferred embodiments, both the first layer and the second layer may be formed separately from the above described shelf area of the can top. For example, in one arrangement the first layer with the vent openings may itself be an easy peel lid membrane with vent openings formed therein. In combination therewith, the second layer can be a separate piece or an extension of this first layer, folded back upon itself, wherein the second layer is sealed to the first layer, covering the vent openings. In this arrangement, one would peel back the second layer from the first layer, uncovering the vent opening or openings, after which the first layer would be peeled back to uncover the product access opening.

In another arrangement of this embodiment, the first and second layers may be formed together as a laminated product, the bottom of the first layer being non-removably sealed to the shelf area of the can top, this first layer containing both the vent openings and the product access opening. The upper laminate would then form the second layer which would be peeled back to first uncover the vent opening or openings and then peeled further back to uncover the product access opening. In this latter arrangement, the lower laminate essentially fulfills the function of the remaining shelf area of the can top in the first described embodiments.

Thus, it is an object of the present invention to provide a new and improved venting closure structure for a package containing a particulate product under pressure.

It is still another object of the present invention to provide a new and improved venting closure structure for a package containing particulate product under pressure, which closure structure allows initial venting of gases, without egress of the particulate product, and which is easily removable from the package.

It is still another object of the present invention to provide a container for roast and ground coffee packaged under pressure, the package including at the end having the product access opening a closure structure having first and second layers, the first layer having the vent opening or openings which permit venting of the gases while restraining the particulate product material and a second layer easily peelable from the first layer to uncover the vent openings and eventually uncover the product access opening.

It is still another object of the present invention to provide a closure structure for a container with particulate product packaged under pressure, which comprises a first layer containing vent opening or openings and a product access opening, and a second layer attached to the first layer with a peelable sealant pattern which controls the timing, size and gas flow rate of the passageways through which the venting gases flow.

These and other objects of the present invention will become apparent from the detailed description to follow, taken together with the accompanying drawings.

BRIEF DESCRIPTION OF THE DRAWINGS

Preferred embodiments of the present invention will now be described in detail with respect to the accompanying drawings, wherein:

FIG. 1 is a side elevation view of a conventional package for roast and ground coffee, with a portion shown in section.

FIG. 2 is a top plan view of a package according to the present invention which is similar to a conventional package on the side and bottom, but wherein the top of the package is formed in accordance with the present invention.

FIG. 3 is a top plan view of a can which will form part of the present invention, showing only a shelf area and its product opening.

FIG. 4 is a partial cross-sectional view taken along line 4—4 of FIG. 3.

DETAILED DESCRIPTION OF THE PREFERRED EMBODIMENTS

Figure 5:
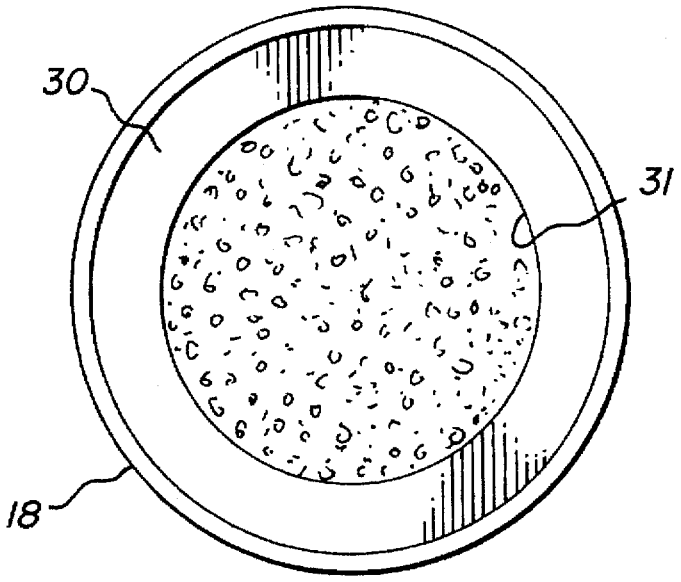
FIGS. 5 and 6 are top plan views similar to FIG. 3 but showing other shelf areas and product opening constructions of the can.

Referring now to the figures, like elements are represented by like numerals throughout the several views.

FIG. 1 illustrates a package 10 which in this case is a conventional can containing a particulate product 11, preferably roast and ground coffee. The can has a side wall 12, a top 13 and a bottom 14. In a conventional can for roast and ground coffee, the top 13 is imperforate and is sealed to the can around periphery 15.

Although roast and ground coffee has in the past been packaged under both pressure and vacuum conditions, the present invention is particularly suitable for use with a roast and ground coffee product packaged under pressure. In this case, the roast and ground coffee need not be degassed, although it may be purged as described above. In any event, it is sealed off under essentially atmospheric conditions or pressurized by addition of an inert gas, creating a pressurized package without degassing, after which the gases contained in the beans, primarily, if not only, carbon dioxide, are released from the beans, creating a pressure which would normally be in the range of 5 to 9 psig.

In accordance with a preferred embodiment of the present invention, the top 13 is designed with an opening which serves as a product opening, which can be of various sizes and dimensions, depending on the particular embodiment of the present invention. In accordance with all embodiments of the present invention, however, the remaining portion of the top 13, which is referred to as the shelf area, has a closure structure attached thereto, which closure structure includes a portion which is easily peeled away to initially uncover vent openings which will permit egress of the pressurized gas within the can, normally carbon dioxide, while preventing egress of the particulate material.

FIG. 2 illustrates a package, in this case a coffee can 18, which is identical to the conventional coffee can 10 of FIG. 1 except for the differing construction of the top. Although the invention may take many different forms, there is shown schematically in FIG. 2 an easy peel lid 20 having a tab 21 which in this case is shown folded back over the body of the lid 20.

As discussed above, the can top of the present invention differs from the conventional can top in that it has a product opening formed therein and it will include a shelf area structure which may or may not contain the vent openings but which will definitely include a surface area of sufficient size for adherence thereto of the easy peel lid. So long as the can top meets this structure, the product opening can have an unlimited number of sizes and shapes, three representative sizes and shapes being shown in FIGS. 3 through 6.

Referring to FIGS. 3 and 4, the can top has a shelf area 22 with a product opening 24 extending therethrough. In this embodiment, one portion of the product opening 24 is formed with a straight line 23 which provides a relatively wide shelf area for placement of vent openings and which also serves as a leveler edge for leveling a teaspoon, tablespoon, scoop or other item used to remove product from the can. In all embodiments, the product opening will preferably have a curled underroll 25, as shown in FIG. 4, to prevent the consumer from injuring his or herself on the edge of the product opening.

FIG. 5 is similar to FIG. 4 except that in this embodiment the container 18 includes a can top having an annular shelf area 30 defining a product opening 31. The embodiment of FIG. 6 includes a circular product opening 33. However, unlike FIG. 5, in FIG. 6 the product opening is relatively smaller and is offset to one side of the can, leaving a shelf area 32 which is larger on one side of the can than on the other side.

Figure 6:
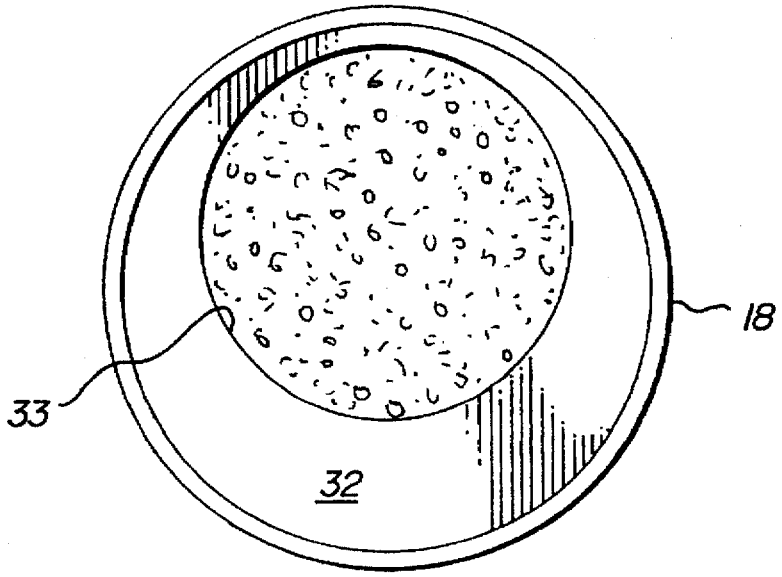

Before discussing specific embodiments of the present invention, it will be noted that one concern which must be addressed when using a relatively thin laminate as the can closing lid is that the pressure which builds up in the can might cause this closure lid to dome outwardly. This doming can be counteracted in several ways. Specifically, doming is less likely to occur, or will occur to a lesser extent the thicker the lid membrane and the larger the shelf area of the container top. Thus, for example when using a can top structure as shown in FIGS. 3 and 6 with an enlarged shelf area, the closure lid can be somewhat thinner; while on the other hand, when using a can top structure as shown in FIG. 5 with a somewhat smaller shelf area 30, a thicker closure lid would be required to minimize doming.

Figure 12:
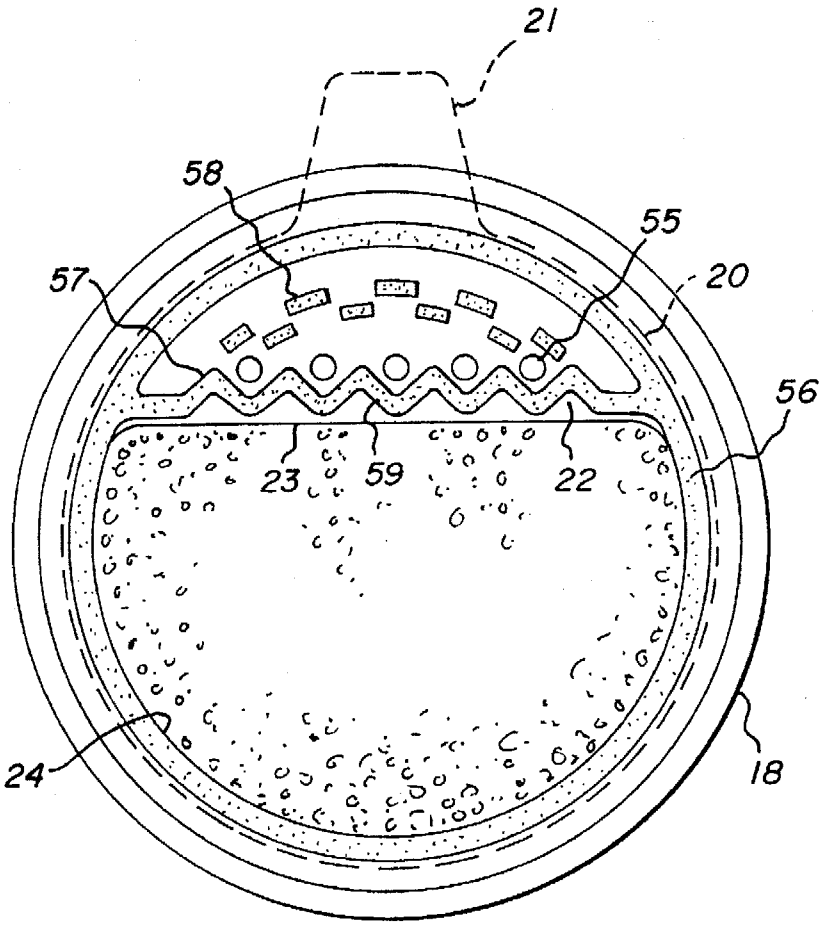
Figure 13:
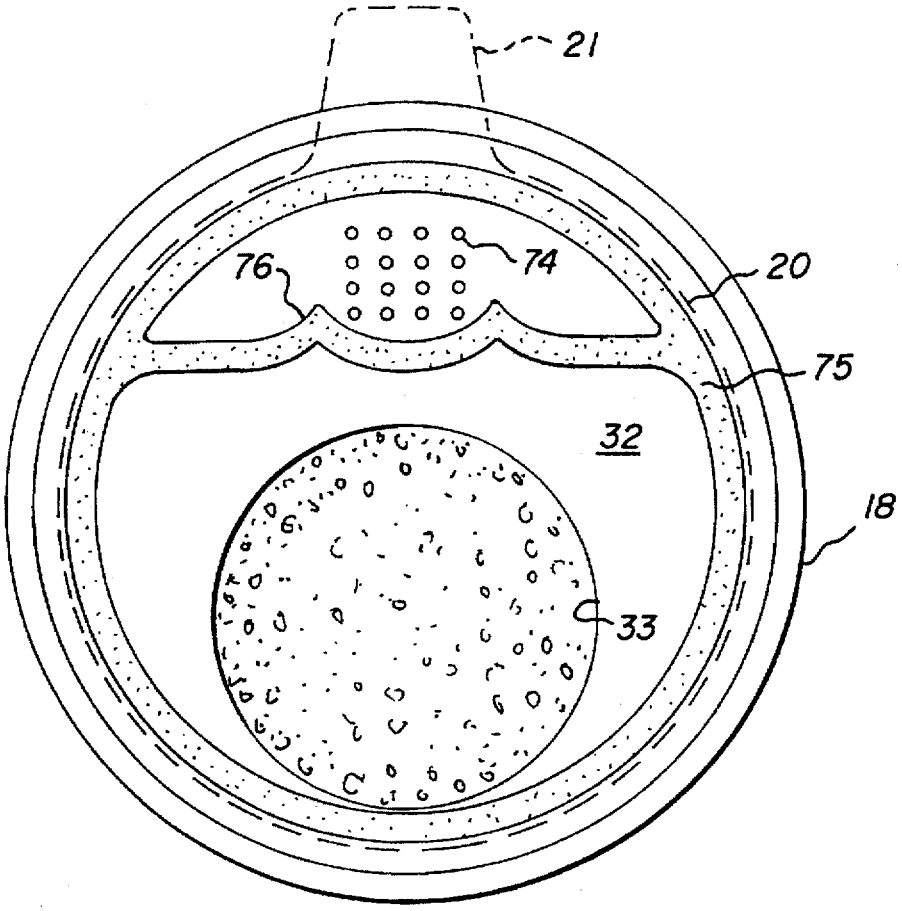
FIG. 13 is a top plan view similar to FIG. 7, showing another embodiment of the invention and utilizing the shelf area and opening construction of FIG. 6.
Figure 14:
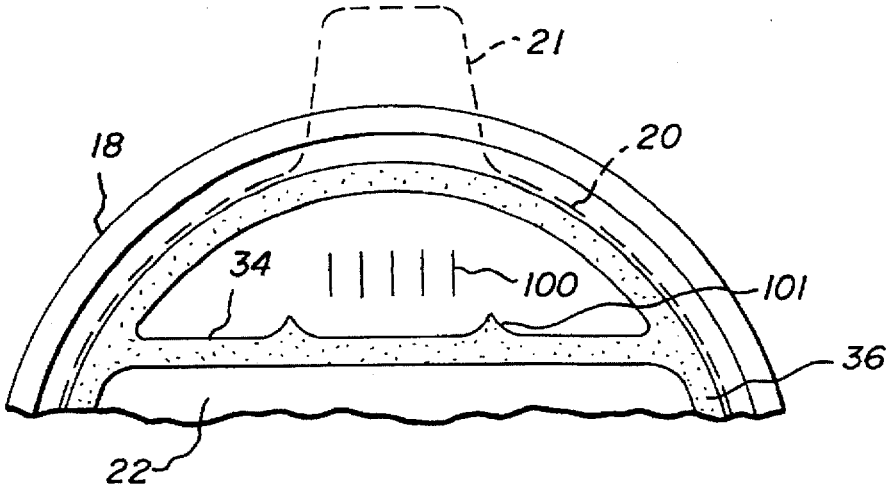
FIG. 14 is a partial plan view similar to FIG. 7, showing modifications of the present invention.
Figure 15A:
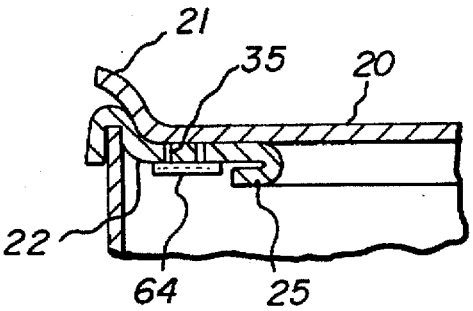
FIGS. 15A and 15B are partial cross sectional views taken through line 15—15 of FIG. 7, and showing modifications of the present invention.
Figure 15B:
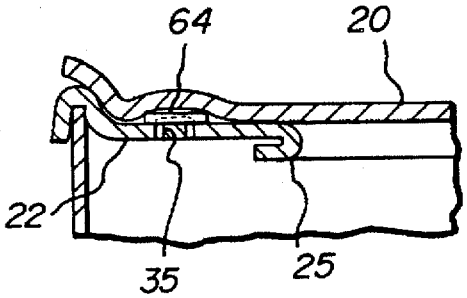

Several advantageous embodiments of the present invention are shown schematically in FIGS. 7 through 13, with modifications thereof shown in FIGS. 14, 15A and 15B. All of these embodiments utilize the container having the can top structure as shown in FIGS. 3, 4 and 6. A cross-sectional view through all of these embodiments taken in this plane of FIG. 4 would be identical to FIG. 4.

Figure 7:
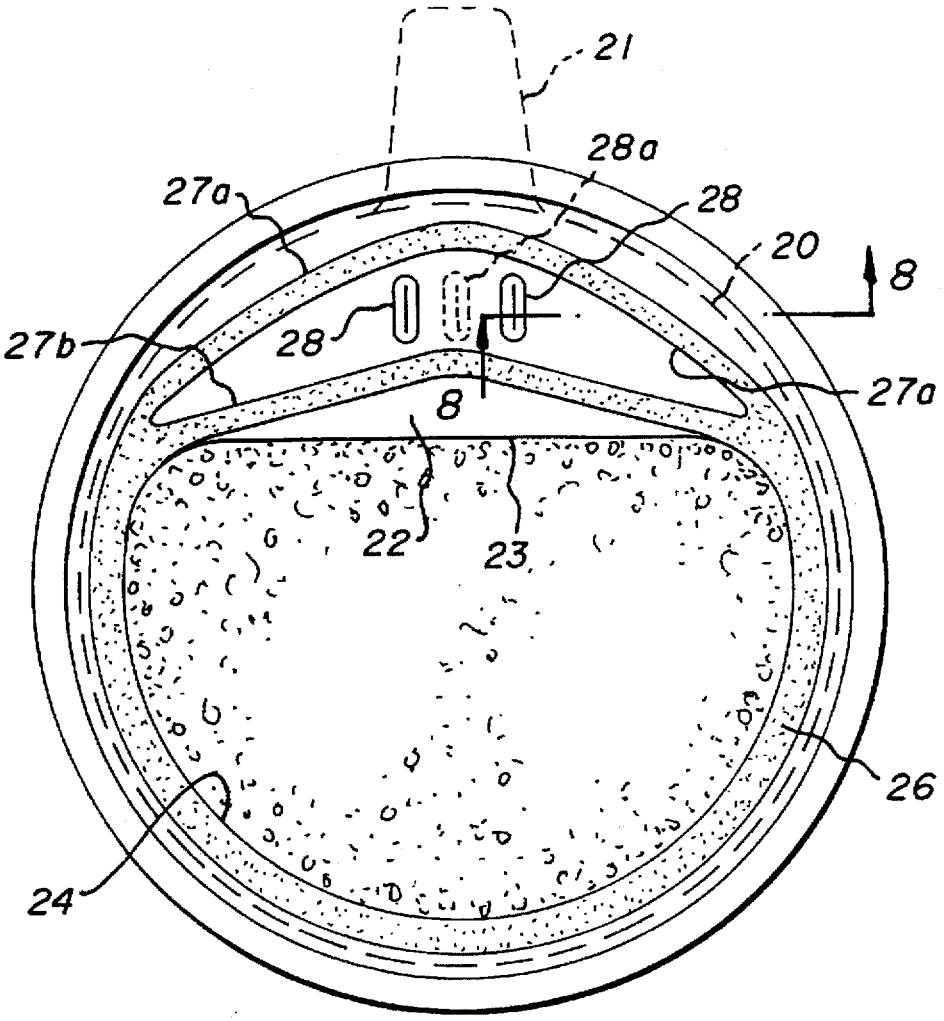
FIG. 7 is a top plan view of a package according to the present invention, with an easy peel lid, which would generally be opaque, shown only in dotted lines so as to reveal therebeneath the product opening in the can, vent openings in the shelf area and the locations on the shelf area having sealant for attachment to the easy peel lid.
Figure 8:
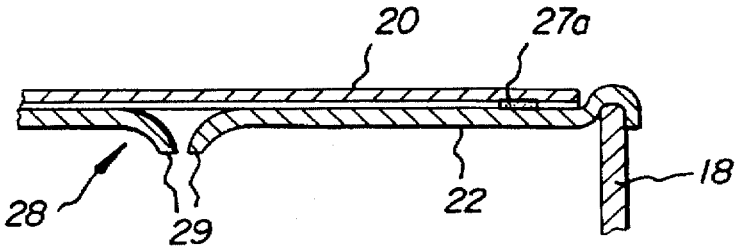
FIG. 8 is an enlarged partial cross-sectional view, taken along line 8—8 of FIG. 7.

Referring to FIGS. 7 and 8, venting would be provided through two single stamped slits 28, as shown therein, or optionally a single, centrally located stamped slit 28*a* shown in dotted lines as an optional variation. The size and number of these stamped slits would determine the desired flow rate of gases exiting from the can. The lower edges 29 of the slit would be close enough together to prevent the egress of particulate material, while spaced sufficiently to allow gas flow between them. The sealant path 26 includes first and second transverse sealant paths 27*a* and 27*b*. In use, the consumer would pull back the tab 21, pulling back the easily peelable lid 20, breaking the first transverse sealant path 27*a* and thereby allowing slits 28 (or if used, 28*a*) to communicate with the atmosphere while the transverse sealant path 27*b* still seals off the product access opening 24. After the initial release of gas, when the pressure inside the can has been reduced to atmospheric pressure, the easily peelable lid 20 would be pulled further back, breaking the transverse sealant path 27*b* and then opening the access opening 24. The slanted back profile of the two transverse sealant paths 27*a* and 27*b* allow those seals to be initially broken at the front center thereof and then pulled back along a slant.

Figure 9:
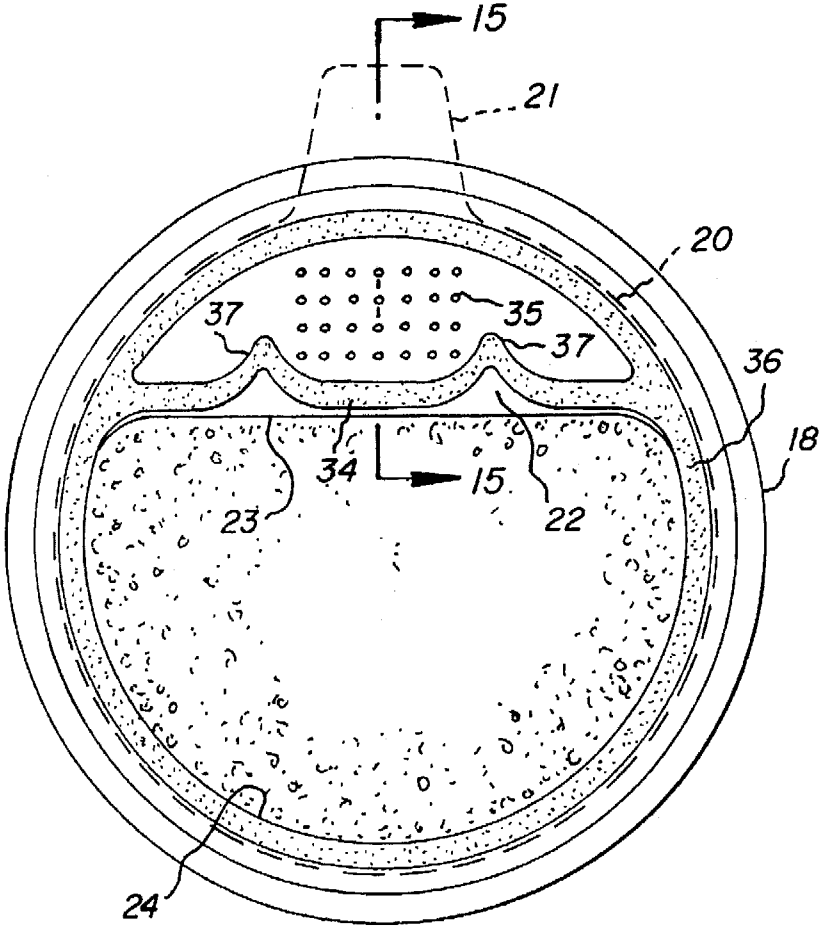

Referring to FIG. 9, venting would be provided through microhole vents 35 formed in the shelf area 22. FIG. 9 illustrates round holes. However, the vents could also be in the form of cuts or slits, as shown at 100 in FIG. 14 or stamped slits as shown in FIGS. 7 and 8. The size and number of these holes, cuts or slits would be formed by any suitable means such as piercing with needles, laser cutting, stamping, etc. The holes will be large enough to permit egress of gases from within the container but small enough to prevent egress of the particulate material. Prior to opening, the easily peelable lid 20 is adhered to the shelf area 22 of the container 18 along sealant locations 36 which include a complete circle just within the outer perimeter of lid 20 and a transverse sealant path 34 extending across the shelf area 22, isolating the vent openings 35 from the product opening 24, this transverse sealant path 34 including a pair of chevrons 37.

In practice, the consumer would grasp the tab 21 and pull it back, initially peeling away the sealant adjacent the tab 21, immediately releasing the pressure within the can, allowing gases to flow through the vent openings 35. At this time of course the product opening 24 is completely sealed by the transverse sealant path 34 and the remaining portion of the circular sealant path. As the consumer initially peels away the lid 20, resistance will be met by the transverse sealant path 34, especially the chevrons 37. This will assure complete venting before the consumer peels away the entire transverse sealant path 34 and the remainder of the circular portion of the sealant path, after which the consumer continues to peel away the lid 20, providing complete access to the product opening 24. The transverse sealant path 34 can take any suitable shape. For example, one simplified variation is shown in FIG. 14, comprising a generally straight line with a pair of points forming chevrons 101. In any event, the chevrons or other suitable transverse sealant path is chosen, for the embodiment of FIG. 9 or for any of the other disclosed embodiments, to provide a brief interlude between the opening of the vent openings, holes, cuts or slits, and the restart leading to removal of more of the lid 20, uncovering the product opening.

Figure 10:
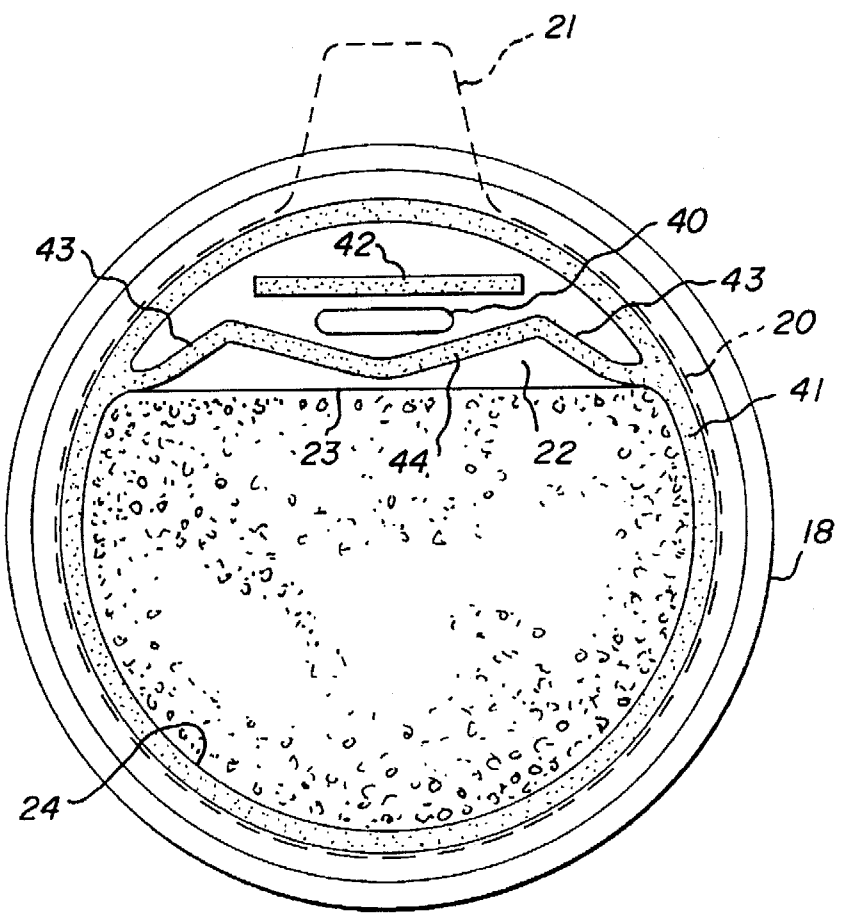
FIGS. 9, 10, 11 and 12 are top plan views similar to FIG. 7 but showing variations in the design and location of the vent opening or openings on the shelf area and the sealant locations.

In FIG. 10 the vent openings 35 are replaced by a relatively large elongated opening 40. The sealant locations 41 include a transverse sealant path 44 with a pair of chevrons 43. This embodiment includes an elongated sealant bar 42. FIG. 10 differs from the embodiment of FIG. 9 in one very important aspect, namely the opening 40 is relatively large so that in and of itself, without additional measures, particulate material could egress through this opening along with the vented gases. In FIG. 10, however, this is prevented by utilizing an additional sealant location, namely a sealant bar 42. Sealant bar 42 is shown as straight, but in practice it can be of any suitable shape. This assures that when the consumer initially peels back the tab 21, breaking the pressure seal in the vicinity of tab 21, the lid 20 is maintained by the sealant bar 42 closely and firmly in place over the elongated opening 40. Consequently, any particulate material which would initially pass through the opening 40 will immediately engage the underside of lid 20 and be restrained by that lid, which acts as a baffle, and also by the relatively long tortuous path from the edge of opening 40 to the point where the gas flow path would no longer be restricted, this being in the vicinity between the ends of the sealant bar 42 and the adjacent chevrons 43 of the transverse sealant path 44. This embodiment has the added advantage of increasing the gas flow initially upon opening, in turn accelerating the favorable burst of aroma occurring upon initial opening of the package.

After the initial gas burst has subsided, the consumer will continue pulling back the tab 21, first peeling away the sealant bar 42 and then, after a short interlude aided by sealant path 44, peeling away the transverse sealant path 44, after some resistance by chevrons 43, gaining access to the product opening 24 and then completely removing the lid 20. Since the lid 20 is completely removed, reclosing of the package would be accomplished by using a conventional plastic snap-on overcap.

Figure 11:
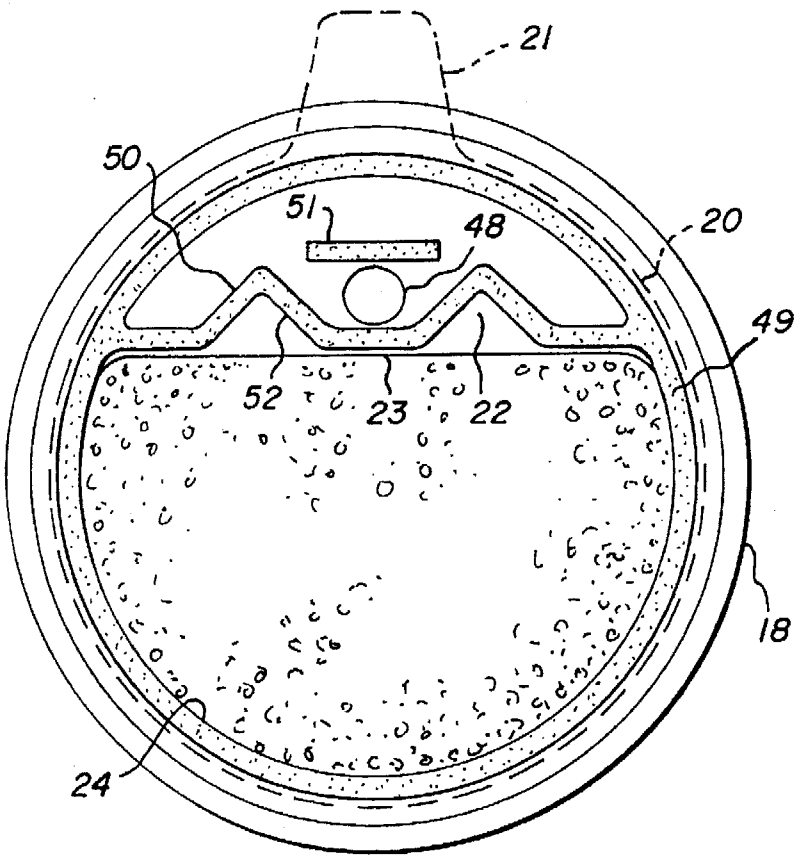

FIGS. 11 and 12 are similar in principle to the embodiment of FIG. 10. They are similarly attached to the container along sealant locations 49, 56, but differ in the construction of the vent opening, the transverse sealant path and the sealant bar or bars. In FIG. 11 a circular relatively large vent opening 48 is bordered by a sealant bar 51. Transverse sealant path 52 includes a pair of chevrons 50. In FIG. 12 there are a plurality of somewhat smaller but not microsize openings 55 (i.e., each opening is large enough that particulate product would egress with the vented gases). The transverse sealant path 59 includes numerous chevrons 57. A pattern of sealant bars 58 are provided in front of the openings 55.

FIGS. 11 and 12 are representative of the numerous different forms which may be employed to embody the principle of FIG. 10 wherein relatively large openings, i.e., large enough for particulate material to pass therethrough, are arranged in combination with sealant bars which retain the lid 20 over these openings as a baffle when the pressure seal is initially cracked. By selecting the size, location and number of the vent openings as well as the size, location and number of the sealant bars, one can control the rate of flow of the vented gases therethrough.

FIG. 13 illustrates still another embodiment of the present invention. As will be apparent, FIG. 13 is very similar to the embodiment shown in FIG. 9 in which venting is provided through microholes 74 and the peelable lid 20 is adhered to the shelf area of the container along sealant locations 75 and a transverse sealant path 76, except in this case the can top construction is that shown in FIG. 6 rather than FIG. 3, thus utilizing the shelf area 32 and the product opening 33. In all other respects, this embodiment is similar to that of FIG. 9. Also, all of the variations discussed with respect to FIGS. 10 through 12, 14, 15A and 15B are equally applicable to the embodiment of FIG. 13.

FIG. 14 is similar to FIGS. 9 and 13, showing modifications. First, the vent openings may take the form of cuts or slits 100 instead of rounded holes. These would preferably extend in a direction parallel to the direction of movement of the tab during opening. Also this figure illustrates a variation of the transverse sealant path 34. This path can take virtually any suitable shape. Here it is shown as a straight line with a pair of points forming chevrons 101.

FIGS. 15A and 15B show a modification of FIG. 9. However, it is to be understood that this modification is applicable to any of the embodiments of FIGS. 7–14. These figures show a gas pervious membrane 64 which may be placed beneath the vent openings as shown in FIG. 15A, or above the vent openings as shown in FIG. 15B. Such a membrane will more positively restrain the particulate product while allowing the pressurized gas to pass therethrough. Membrane 64 may be made of any suitable material such as cloth, filter paper, gauze, woven plastic, or any other material which permits gas flow while preventing egress of particulate material.

Figure 16:
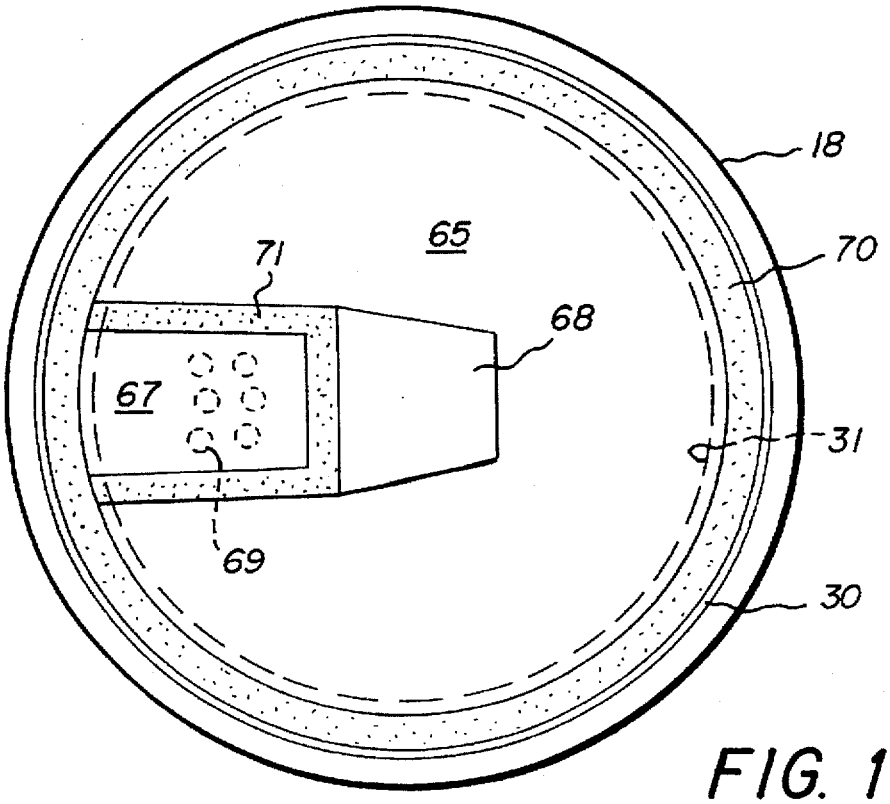
FIG. 16 is a top plan view showing another embodiment of an easy peel lid on a package having a shelf area and product opening construction as shown in FIG. 5.
Figure 17:
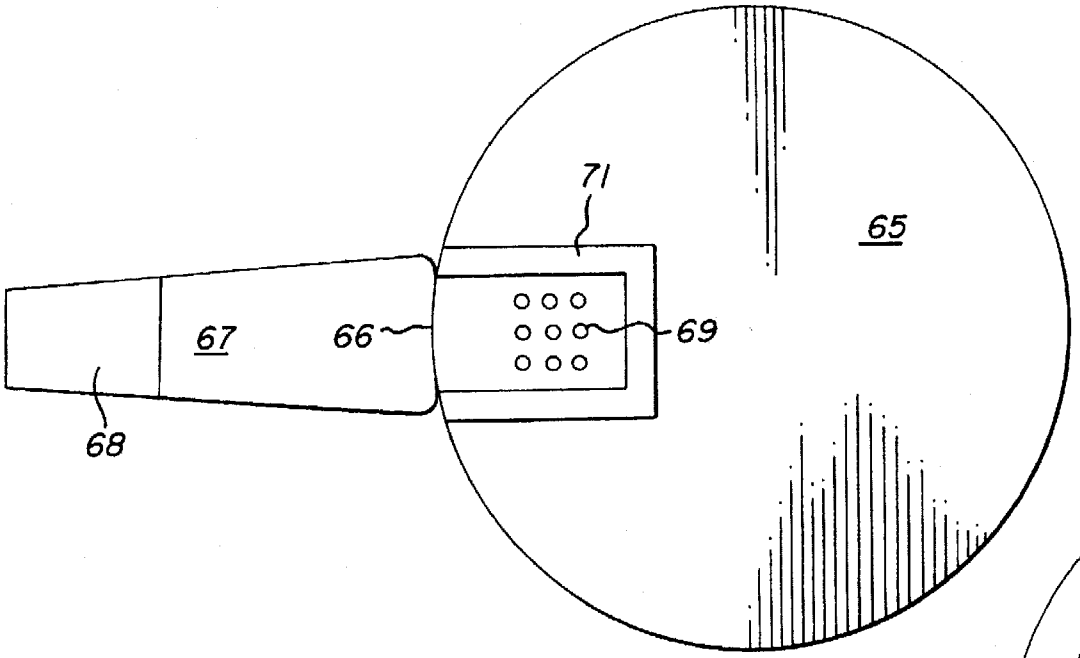
FIG. 17 illustrates the easy peel lid of FIG. 16, shown separately from the package and partially opened.

FIGS. 16 and 17 illustrate another embodiment of the invention, this one using the can top construction as shown in FIG. 5. In this embodiment, unlike the previously described embodiments, the vent openings are not provided in the shelf area. Instead, in this embodiment there is provided an easy peel lid including a fold-over feature. The lower layer 65 of this fold-over easy peel lid is sealed to the shelf area 30 in a circular sealant path as shown at 70. In FIG. 16, the lid is shown as opaque and the product opening 31 located therebeneath is shown in dotted lines. Lower layer 65 is connected across a fold line 66 to an upper layer 67 which includes a tab 68. Vent openings 69 are formed in the lower layer 65. When the upper layer 67 is folded over onto 65, it will be adhered thereto along any sealant path which fully seals the vent openings 69. One example of such a sealant path is shown at 71. The sealant in area 71 connecting the upper layer 67 to the lower layer 65 is of lesser strength than the sealant 70 used between the layer 65 and the shelf area 30. The vent openings may be formed as holes, as shown at 69 in FIGS. 16 and 17, or as cuts or slits, as shown at 102 in FIG. 18. Also, according to another variation, which is useable with any type of vent openings, the second layer 67 may be detached from 65, as shown at 103 in FIG. 18. In this case of course, the sealant area 104 around the vent openings must extend at the periphery of 65 to fully enclose the vent openings. Also, of course another tab such as 105 must be provided on 65 to remove it to uncover the product opening.

Figure 18:
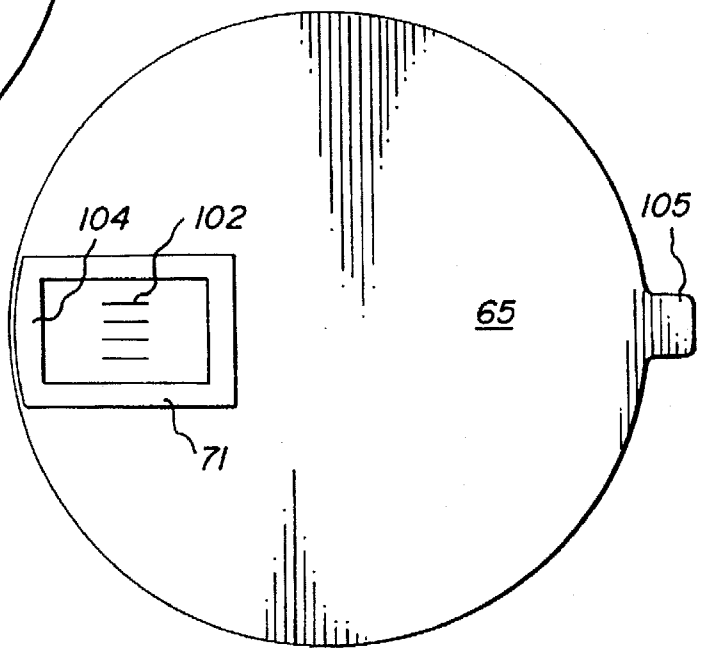
FIG. 18 is a view similar to FIG. 17, but showing modifications of the present invention.
Figure 18:
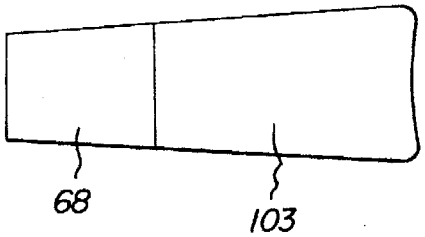

It will be understood that in the embodiment of FIGS. 16 to 18 the construction and arrangement of the vent openings and the various sealant patterns therearound can be modified as shown in FIGS. 10 through 14 or in other ways to control the nature of the gas flow during venting. However, there will be no need for a transverse sealant path such as 34, 44, etc., because in this case continued movement of the tab 68 in the same direction will not result in uncovering the product opening. Instead, as will be evident from the figures, in the embodiment of FIGS. 16 and 17, when the tab 68 is pulled far enough to the left to complete initial venting (it need not be pulled all the way to the fold line 66) the consumer will then pull the tab 68 back to the right, thereby peeling away the lower layer 65 from the shelf area 30 to uncover the product opening 31 while in FIG. 16, after layer 67 is removed, tab 105 is pulled to remove layer 65.

Figure 19:
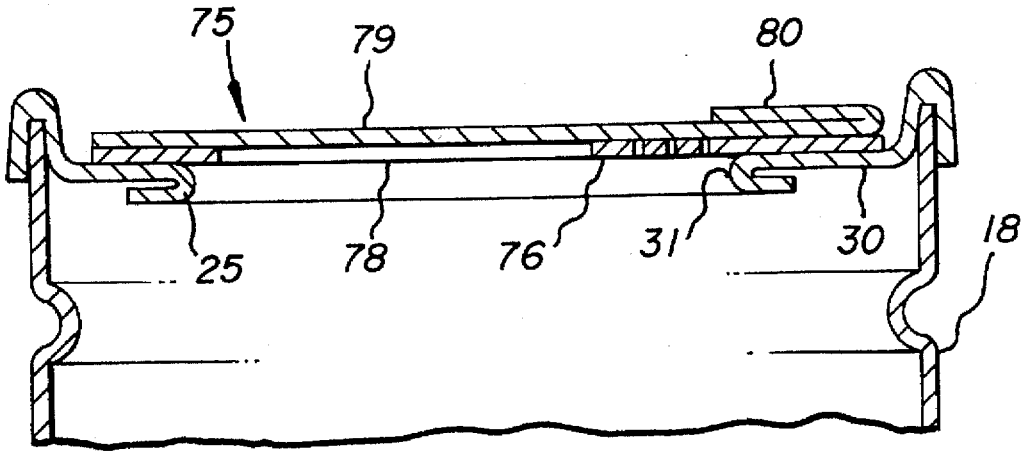
FIG. 19 is a cross-sectional view of a particulate product package having a top shelf area structure as shown in FIG. 5 and illustrating another embodiment of the easy peel lid of the present invention.
Figure 20:
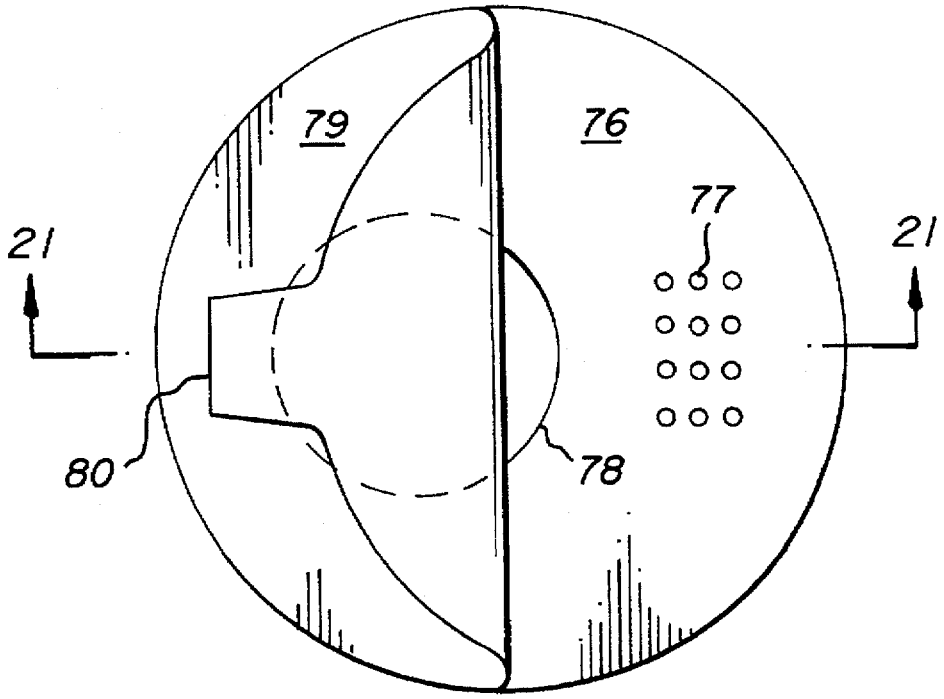
FIG. 20 illustrates the easy peel lid of FIG. 19, shown separately from the package and shown partially opened.
Figure 21:
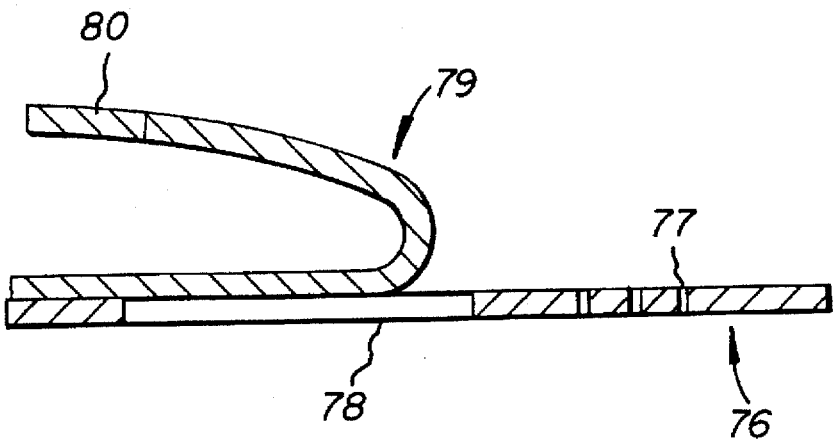
FIG. 21 is a cross-sectional view taken along line 21—21 of FIG. 20.

FIGS. 19 through 21 illustrate still another embodiment of the present invention. In this embodiment, using an upper lid construction as shown in FIG. 5, the product opening and the vent opening are all formed together in a lower laminate product 75. The lower laminate 76 is permanently attached to the shelf area 30. This laminate includes vent openings 77 and a product opening 78. An upper laminate 79 completely covers the lower laminate 76 and is peelable therefrom, first to uncover the vent openings 77 and then to uncover the product opening 78.

Figure 22:
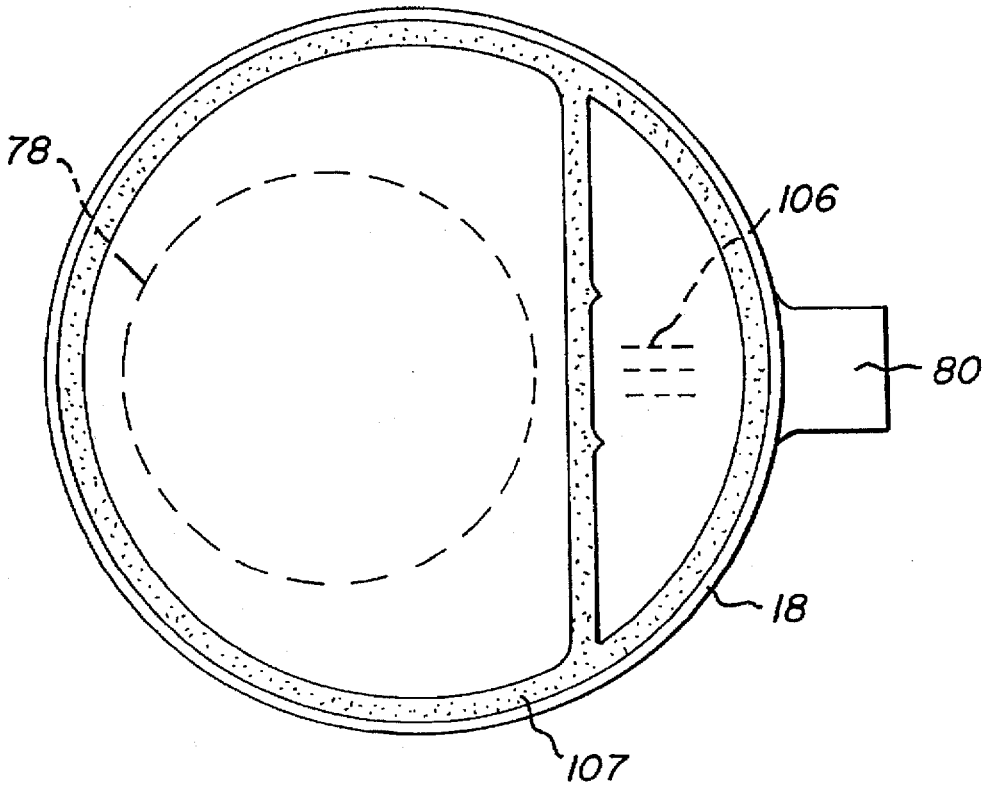
FIG. 22 is a top plan view of FIG. 19, showing modifications of the present invention.

The lower laminate 76 and the upper laminate 79 would preferably be made of a foil and sealant combination which could be a foil with plastic coating as the heat sealant. The heat seal of 76 to 79 would be weaker than the heat seal of 79 to shelf area 30. The vent openings can be microholes, as shown at 77 in FIGS. 19–21 or cuts or slits, as shown at 106 in FIG. 22. The layer 79 can be adhered to 76 throughout its area, or according to any selected sealant path, as described earlier in this specification, one of which is shown at 107 in FIG. 22.

In operation, the consumer grasps the folded back tab 80 and pulls it to the left, as shown in FIGS. 18 and 19 to first uncover the vent openings 77 or 106 and then to uncover the product opening 78. The consumer continues to pull tab 80 until the entire laminate structure is completely removed.

Although the invention has been described in considerable detail with respect to preferred embodiments thereof, it will be apparent that the invention is capable of numerous modifications and variations, apparent to those skilled in the art without departing from the spirit and scope of the invention.

We claim:

1. A cylindrical container containing a particulate product packaged under pressure relative to the surrounding atmosphere, comprising:

a top having a product access opening therein of a size sufficient for access to and removal of the particulate product when said container is in an upright position, and at least one vent opening which is positioned to be opened prior to operable opening of the product access opening so as to permit the flow of pressurized gases therethrough while minimizing movement of the particulate product outwardly therethrough;

a lid having a first portion covering the product access opening and a second portion covering the at least one vent opening, said lid comprising a flexible material;

a first peelable seal connecting the first portion of the lid to the top; and a second peelable seal attaching the second portion of the lid to the top so as to surround and hence close off the at least one vent opening, the second peelable seal being positioned to be opened to uncover the at least one vent opening so as to minimize movement of particulate product outwardly through the at least one vent openings and past the second portion and without operable opening of the product access opening and with the first peelable seal still in place, the first peelable seal being positioned to be opened, to uncover the product access opening, after the second peelable seal has been opened and the gases have been vented outwardly therethrough.

2. A container according to claim 1, wherein the container includes a fixed shelf area attached to the container, which shelf area includes both the product opening and the at least one vent opening, said lid being attached to said shelf area.

3. A container according to claim 2, including a transverse sealant path between the at least one vent opening and the product opening, whereby upon opening of the at least one vent opening, the transverse seal continues to seal off the product opening.

4. A container according to claim 3, wherein the transverse sealant path is V-shaped, the tip of the V pointing away from the product opening and the remainder of the transverse sealant paths sloping back therefrom on each side.

5. A container according to claim 3, wherein the at least one vent opening comprises a plurality of microholes large enough to permit egress of gas but small enough to prevent egress of the particulate material.

6. A container according to claim 3, wherein the at least one vent opening comprises a plurality of slits large enough to permit egress of gas but small enough to prevent egress of the particulate material.

7. A container according to claim 3, wherein the product opening includes a straight edge along a portion of its periphery.

8. A container according to claim 3, wherein the at least one vent opening includes one or more large holes of sufficient size to permit egress of particulate product, and including a sealant bar between the lid and the shelf area, maintaining the lid in close proximity over the large hole or holes after the pressure seal between said holes and the surrounding atmosphere has been broken, such that the lid acts as a baffle to create a tortious gas flow path from the large hole or holes to the surrounding atmosphere.

9. A container according to claim 8, wherein the vent opening is a single large hole.

10. A container according to claim 8, wherein the at least one vent opening is a plurality of large holes.

11. A container according to claim 4, including a further transverse sealant path between the at least one vent opening and the edge of the lid, and wherein the portion of the further sealant path between the at least one vent opening and the edge of the lid is also V-shaped, the tip of the V also pointing away from the product opening.

12. A container according to claim 1, wherein the vent opening is a single stamped slit.

13. A container according to claim 1, wherein the vent opening is a plurality of stamped slits.

14. A container according to claim 1, comprising a fixed shelf area comprising a product opening, said lid comprising a first flexible layer adhered to the shelf area and containing said at least one vent opening therein and a second layer peelably attached to the first layer and covering the at least one vent opening.

15. A container according to claim 14, the second layer being one piece with and hinged to the first layer.

16. A container according to claim 14, wherein the second layer is a separate piece from the first layer.

17. A container according to claim 14, wherein the at least one vent opening comprises a plurality of approximately round microholes large enough to permit egress of gas but small enough to prevent egress of the particulate material.

18. A container according to claim 14, wherein the at least one vent opening comprises a plurality of slits large enough to permit egress of gas but small enough to prevent egress of the particulate material.

19. A container according to claim 1, said container top including a shelf area, said lid comprising a first flexible layer adhered to the shelf area and having the product opening and said at least one vent opening, a second flexible layer covering both the at least one vent opening and the product opening, said second layer being peelably removable from the first layer to first uncover the at least one vent opening and then to uncover the product opening.

20. A container according to claim 19, wherein the at least one vent opening comprises a plurality of approximately round microholes large enough to permit egress of gas but small enough to prevent egress of the particulate material.

21. A container according to claim 19, wherein the at least one vent opening comprises a plurality of slits large enough to permit egress of gas but small enough to prevent egress of the particulate material.

22. A container according to claim 19, wherein the second layer is adhered to the first layer over the entire surface area where they contact each other.

23. A container according to claim 19, wherein the second layer is adhered to the first layer by a sealant path extending around the periphery of the lid and also including a transverse seal between the product opening and the at least one vent opening.

24. A container according to claim 19, wherein the seal between the second layer and the first layer is weaker than the seal between the first layer and the shelf area.

25. A container according to claim 24, wherein the second layer comprises a plastic and foil laminate and the first layer is a foil laminate.

26. A cylindrical container containing a particulate product packaged under pressure relative to the surrounding atmosphere, comprising:

a metallic can having a sidewall;

a metallic top sealingly engaged to said sidewall and having a product access opening therein of a size sufficient for access to and removal of the particulate product when the can is in an upright position, and at least one vent opening which is positioned to be opened prior to operable opening of the product access opening so as to permit the flow of pressurized gases therethrough while minimizing movement of the particulate product outwardly therethrough;

a lid comprising a flexible material peelably attached to the metallic top and having a first portion covering the product access opening and a second portion covering the at least one vent opening;

a first sealant path peelably attached to the metallic top to define said first portion, and a second sealant path peelably attached to the metallic top to define the said second portion;

a transverse sealant path peelably attached to the metallic top and forming a part of the first and second sealant paths such that when the second sealant path is removed to expose the at least one vent opening outward flow of particulate product through the vent opening and past the second portion is minimized, the transverse sealant path along with the remainder of the first sealant path continues to seal the product access opening, after which removal of the first sealant path uncovers the access opening.

27. A container according to claim 26, the sealant path comprises a circular path around the periphery of the top of the can.

28. A container according to claim 26, wherein the at least one vent opening comprises a plurality of approximately round microholes large enough to permit egress of gas but small enough to prevent egress of the particulate material.

29. A container according to claim 26, wherein the at least one vent opening comprises a plurality of slits large enough to permit egress of gas but small enough to prevent egress of the particulate material.

30. A container according to claim 26, wherein the at least one vent opening includes one or more large holes of sufficient size to permit egress of particulate product, and including a sealant bar positioned such that the vent opening is located between the sealant bar add the transverse sealant path, maintaining the lid in close proximity over the large hole or holes after the pressure seal between said holes and the surrounding atmosphere has been broken, such that the lid acts as a baffle to create a tortious gas flow path from the large hole or holes to the surrounding atmosphere.

31. A container according to claim 30, wherein the at least one vent opening is a single large hole.

32. A container according to claim 30, wherein the at least one vent opening is a plurality of large holes.

33. A container according to claim 1, wherein the product opening includes a straight edge along a portion of its periphery.

34. A container according to claim 26 wherein said vent opening comprises at least one stamped slit large enough to permit egress of gas but small enough to prevent egress of the particulate material.

35. A container according to claim 34 wherein said stamped slit is centrally located within said second portion of the lid.

36. A container according to claim 34 wherein said vent opening comprises two stamped slits.

37. A container for a particulate product packaged with a pressure differential between the interior of the container and the surrounding atmosphere, comprising:

a top having a product access opening therein of a size large enough for access to and removal of a particulate product;

a first peelable membrane for covering said product access opening, said first peelable membrane having at least one vent opening therein and positioned over said product access opening; and a second peelable membrane positioned over said vent opening to allow opening of the one vent opening so as to permit the flow of gases therethrough while minimizing movement of the particulate product therethrough, said first peelable membrane remaining intact over the product access opening when said second peelable membrane is opened.

38. A container according to claim 37, the second layer being one piece with and hinged to the first layer.

39. A container according to claim 37, wherein the second layer is a separate piece from the first layer.

40. A container according to claim 37, wherein the at least one vent opening comprises a plurality of approximately round microholes large enough to permit egress of gas but small enough to prevent egress of the particulate material.

41. A container according to claim 37, wherein the at least one vent opening comprises a plurality of slits large enough to permit egress of gas but small enough to prevent egress of the particulate material.

* * * * *